US007048130B2

(12) United States Patent
Hurst

(10) Patent No.: US 7,048,130 B2
(45) Date of Patent: May 23, 2006

(54) CAN HOLDER

(76) Inventor: Donald H. Hurst, 1129 E. 33rd St., No. 504, Hutchinson, KS (US) 67502

( * ) Notice: Subject to any disclaimer, the term of this patent is extended or adjusted under 35 U.S.C. 154(b) by 202 days.

(21) Appl. No.: 10/686,626

(22) Filed: Oct. 17, 2003

(65) Prior Publication Data

US 2005/0082242 A1 Apr. 21, 2005

(51) Int. Cl.
*A47F 7/00* (2006.01)

(52) U.S. Cl. ..... 211/74; 211/71.01

(58) Field of Classification Search ..... 211/74, 211/85.18, 71.01; 206/443, 486, 488; 248/74.3, 248/315, 229.17, 228.8, 230.8, 313, 505
See application file for complete search history.

(56) References Cited

U.S. PATENT DOCUMENTS

| | | | | |
|---|---|---|---|---|
| 1,869,717 A | | 8/1932 | Silver | |
| 3,731,819 A | | 5/1973 | Sandhage | |
| D232,286 S | | 8/1974 | Galuten | |
| 3,884,439 A | * | 5/1975 | Jeninga | 248/96 |
| 4,560,535 A | | 12/1985 | Bouchee | |
| D297,079 S | | 8/1988 | Weldon | |
| 4,947,991 A | | 8/1990 | Snell | |
| 5,042,770 A | * | 8/1991 | Louthan | 248/311.2 |
| 5,078,155 A | | 1/1992 | Grandel | |
| 5,100,007 A | * | 3/1992 | Espasandin et al. | 211/85.18 |
| 5,154,556 A | * | 10/1992 | Wappel | 410/36 |
| 5,335,814 A | | 8/1994 | Hepp | |
| 5,913,444 A | | 6/1999 | Steiner | |
| 6,769,659 B1 | * | 8/2004 | Martello | 248/311.2 |
| 2003/0150826 A1 | * | 8/2003 | Sheckells | 211/85.18 |

FOREIGN PATENT DOCUMENTS

| | | |
|---|---|---|
| GB | 2265304 | 9/1993 |

* cited by examiner

*Primary Examiner*—Jennifer E. Novosad
(74) *Attorney, Agent, or Firm*—Stephen R. Greiner

(57) ABSTRACT

A can holder including an elongated body with a plurality of holes and a plurality of slots spaced along its length. Each of the slots intersects a respective one of the holes. A strap is positioned within each one of the holes. One end of each strap is affixed to the elongated body and the other end of each strap slidably extends through a respective one of the slots. A number of releasable fasteners selectively secure the strap ends extending through the slots to the elongated body.

2 Claims, 1 Drawing Sheet

CAN HOLDER

FIELD OF THE INVENTION

The present invention relates generally to supports and racks having receptacles for receiving articles like bottles, jars and cans.

BACKGROUND OF THE INVENTION

Skilled martial artists often have a difficult time honing their skills since sparring partners willing to receive blows delivered with significant force are scarce. So, martial artists frequently use breakable targets such as boards and bricks to increase their striking accuracy, power and confidence. The targets are usually held by another person at different heights so that a martial artist can vary his routine and practice different maneuvers. Unfortunately, if someone is not available to hold a target, or if the martial artist runs out of funds to purchase relatively expensive targets like boards and bricks, practice cannot be undertaken. Thus, a need exists for a product that permits a martial artist to strike a number of inexpensive targets in succession while practicing alone.

SUMMARY OF THE INVENTION

In light of the problems associated with the known methods and apparatus for practicing martial arts kicks and punches, it is a principal object of the invention to provide a holder for a number of aluminum cans used to distribute beverages. Emptied cans positioned within the holder may be easily crushed with little risk of injury, minimal cost and no personal assistance to a martial artist. By noting the damage imparted to a struck can, the martial artist can gauge the accuracy and power of a strike.

It is another object of the invention to provide a holder of the type described that permits a user can positively lock a can within such. Thus, a sideways or glancing blow to a can will not dislodge the can from the holder. Further, the locking mechanism permits cans of varying diameter to be accepted by the holder.

It is a further object of the invention to provide a holder of the type described that retains a large number of cans so that a martial artist need not stop frequently during practice sessions to recharge the holder with undamaged targets or cans. So, practice sessions can continue unabated for long periods of time.

It is an object of the invention to provide improved elements and arrangements thereof in a can holder for the purposes described which is lightweight in construction, inexpensive to manufacture, and dependable in use.

Briefly, the can holder in accordance with this invention achieves the intended objects by featuring an elongated body having a can-retaining member with a plurality of spaced-apart holes passing from its front to its back and a plurality of spaced-apart slots penetrating its sides to intersect the holes. A backing plate is affixed to the can-retaining member so as to close the holes at the back of the can-retaining member. A strap is positioned within each one of the holes with one of its ends being affixed to the can-retaining member and the other of its ends slidably extending through a respective one of the slots. A plurality of releasable fasteners selectively secure the strap ends extending through the slots to the can-retaining member.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
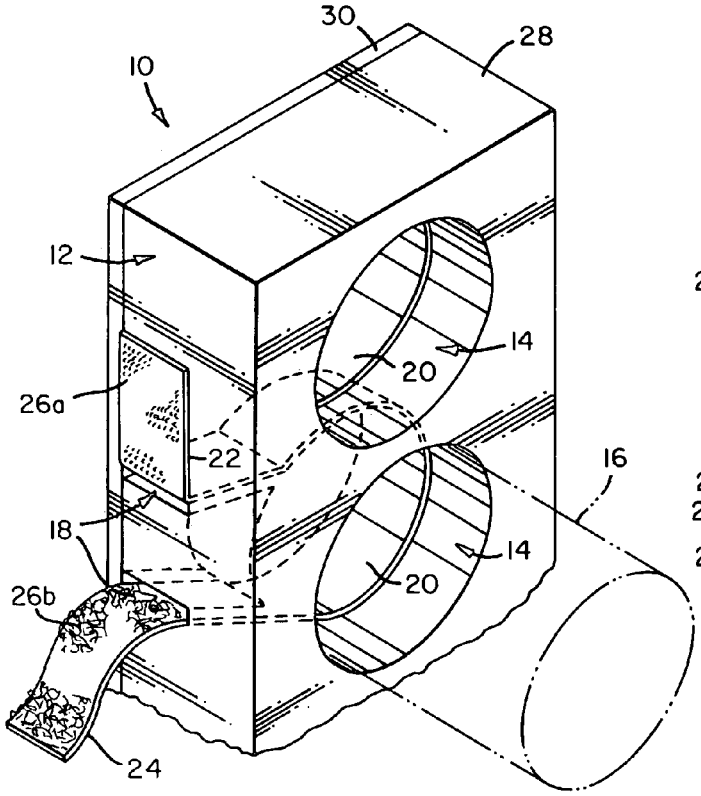
FIG. 1 is an enlarged perspective view of a can holder in accordance with the present invention with the lower portion thereof being broken away.
Figure 2:
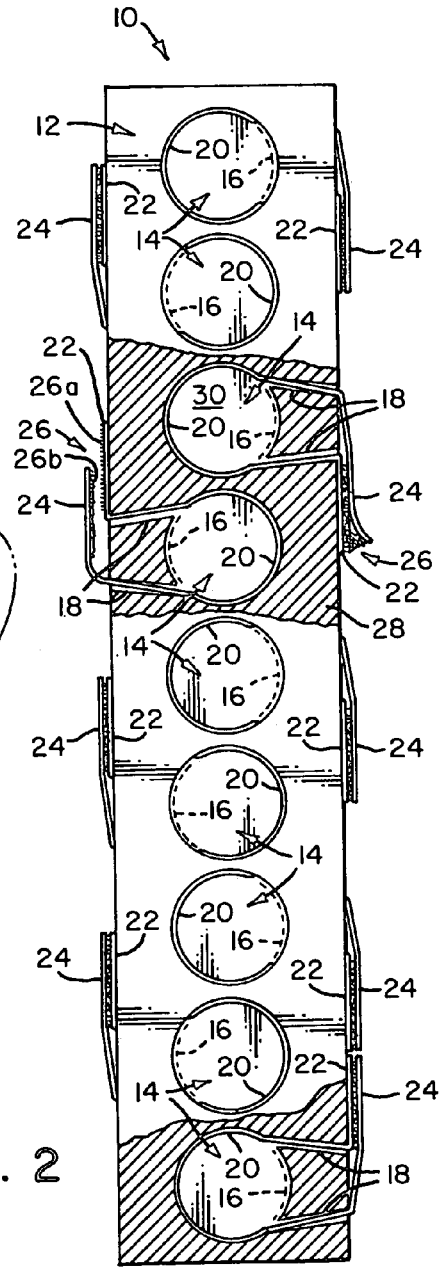
FIG. 2 is a front view of the can holder of FIG. 1 with portions broken away to reveal interior details thereof.

Referring now to the FIGS., a can holder in accordance with the present invention is shown at 10. Can holder 10 includes an elongated body 12 with a plurality of holes 14 spaced along its length. Each of holes 14 has a diameter sufficient to receive an aluminum can 16 of the type employed to distribute soft drinks. A pair of slots 18 in body 12 intersects each of holes 14. A strap 20 is positioned within each of holes 14 to wrap around a can 16 and with its opposite ends 22 and 24 extending outwardly through slots 18. End 22 of each strap 20 is affixed to body 12 so that its movement through a slot 18 is prevented whereas the other end 24 of each strap 20 is free to slide through a slot 18. The end 24 of each strap 20 can be attached to body 12 by means of a releasable fastener 26 to lock a can 16 in a hole 14.

Elongated body 12 has a can-retaining member 28 through which holes 14 and slots 18 penetrate and a backing plate 30 affixed to can-retaining member 28 that serves as a stop to prevent cans 16 from passing through body 12 when inserted into holes 14 or when cans 16 are subsequently struck with a blow. As shown, can-retaining member 28 and has a thickness sufficient to partially receive cans 16 and support such in a stable, cantilevered fashion as they project outwardly from body 12. Backing plate 30, however, is coextensive with can-retaining member 28 and has a thickness sufficient to resist repeated blows that may be imparted to cans 16. If desired, can-retaining member 28 and backing plate 30 can be integrally formed from a suitable material rather than being formed as separate parts as described herein.

Holes 14 are circular in outline and of equal size. Holes 14 fully penetrate can-retaining member 28 to extend from the front to the back of can-retaining member 28. Additionally, holes 14 are linearly arranged and are evenly spaced from one another.

Each pair of slots 18 passes through one side of can-retaining member 28 to intersect a hole 14. One slot 18 of each pair intersects the top of a hole 14 and the other slot 18 intersects the bottom of a hole 14. As shown, the slots 18 of each pair are not parallel to one another but, rather, tend to converge toward their outer ends remote from a hole 14. This convergence permits the ends 22 and 24 of each strap 20 to exit its associated hole 14 with a minimum of binding.

End 22 of each strap 20 extends outwardly through a slot 18 and is affixed to one side of can-retaining member 28. One portion 26*a* of each releasable fastener 26 is affixed atop each end 22 and comprises a piece of hook-type fastening material. Hook-type fastening material is also known as "Velcro" hook material and has a plurality of transverse lines of hooks spaced along its length, the ends of which are turned inwardly.

Another portion 26*b* of each releasable fastener 26 is secured to end 24 of each strap 20. Portion 26*b* comprises a piece of loop-type fastening material, a.k.a. "Velcro" loop material, being a dense mat of small, uncut loops formed a thread. The ends of the loops catch in the hooks of portion 26*a* when fastening portions 26*a* and 26*b* are pressed together. Since fastening portions 26*a* and 26*b* are relatively long, portions 26*a* and 26*b* can be fastened together at various points. Thus, strap 20 can be adjusted to tightly encircle cans 16 of varying diameters.

Use of can holder 10 is straightforward. First, can holder 10 is placed against, or is secured to, a vertical support like a building wall. Then, with straps 20 positioned flush against the sides of holes 14, one or more cans 16 are inserted into holes 14. Next, ends 24 are pulled to tighten straps 20 around cans 16 and fastening portions 26*b* are pressed against fastening portions 26*a* to lock cans 16 in holes 14. Now, cans 16 may be kicked or otherwise struck by a user practicing martial arts maneuvers with straps 20 ensuring that cans 16 not become disengaged from holder 10. When all of cans 16 are crushed or damaged to the point that they can no longer be used to mark the accuracy of a blow, they can be easily removed from holder 10 simply by reversing the steps outlined above. Once the damaged cans 16 are removed, holder 10 is ready for immediate reuse.

While the invention has been described with a high degree of particularity, it will be appreciated by those skilled in the art that modifications may be made thereto. For example, ends 22 of straps 20 could be secured within holes 14 thereby permitting one of the slots 18 associated with each hole 14 to be eliminated. However, this arrangement does not permit strap 20 to carry fastening portion 26*a*, making construction of holder 10 somewhat more difficult. Therefore, it is to be understood that the present invention is not limited to the sole embodiment described above, but encompasses any and all embodiments within the scope of the following claims.

I claim:

1. A can holder, comprising:

an elongated body with a plurality of holes and slots spaced along its length, each of said slots intersecting a respective one of said holes;

a plurality of straps, each being positioned within a respective one of said holes, one end of each of said straps being affixed to said elongated body and the other end of each of said straps slidably extending through a respective one of said slots; and, a plurality of releasable fasteners for selectively securing said end extending through one of said slots of each of said straps to said elongated body.

2. The can holder according to claim 1 wherein said releasable fasteners comprise hook and loop fasteners.

* * * * *